US007625170B2

(12) United States Patent
Greene et al.

(10) Patent No.: US 7,625,170 B2
(45) Date of Patent: Dec. 1, 2009

(54) CMC VANE INSULATOR AND METHOD OF USE

(75) Inventors: John Greene, Greenville, SC (US); Ronald Ralph Cairo, Greer, SC (US); Paul Steven Dimascio, Greer, SC (US); Nitin Bhate, Rexford, NY (US); Jason Thurman Stewart, Greenville, SC (US)

(73) Assignee: General Electric Company, Schenectady, NY (US)

( * ) Notice: Subject to any disclaimer, the term of this patent is extended or adjusted under 35 U.S.C. 154(b) by 324 days.

(21) Appl. No.: 11/526,501

(22) Filed: Sep. 25, 2006

(65) Prior Publication Data

US 2009/0232644 A1 Sep. 17, 2009

(51) Int. Cl.
*F01D 11/00* (2006.01)

(52) U.S. Cl. ..... 415/110; 415/209.4; 415/210.1

(58) Field of Classification Search ..... 415/110, 415/114, 115, 116, 191, 209.4, 210.1; 29/889.22
See application file for complete search history.

(56) References Cited

U.S. PATENT DOCUMENTS 4,907,946 A 3/1990 Ciokajlo et al.
6,514,046 B1 2/2003 Morrison et al.
6,702,550 B2 3/2004 Darkins, Jr. et al.
7,052,234 B2 * 5/2006 Wells et al. ..... 415/137
7,123,031 B2 10/2006 Twerdochlib
7,153,096 B2 12/2006 Thompson et al.
7,198,458 B2 4/2007 Thompson
2006/0226290 A1 10/2006 Campbell
2007/0065285 A1 3/2007 Cairo et al.
2008/0112804 A1 * 5/2008 Bhate et al. ..... 415/209.3

* cited by examiner

*Primary Examiner*—Edward Look
*Assistant Examiner*—Ryan H Ellis
(74) *Attorney, Agent, or Firm*—Armstrong Teasdale LLP

(57) ABSTRACT

A method for assembling a gas or steam turbine is provided. The method includes providing an insulator and positioning the insulator between a vane support and a vane such that the insulator facilitates preventing hot gas migration into the vane, and such that during operation, hot gas is channeled from a high pressure side of the vane to a low pressure side of the vane. A vane assembly for a turbine rotor assembly is also provided. The vane assembly includes a vane support and an insulator including a projecting portion. The assembly also includes a vane. The insulator is coupled to the vane support such that the projecting portion is between the vane and a nozzle support strut to facilitate hot gas flow from a pressure side of the projecting portion to a suction side of the projecting portion.

19 Claims, 7 Drawing Sheets

CMC VANE INSULATOR AND METHOD OF USE

BACKGROUND OF THE INVENTION

This invention relates generally to the use of ceramic matrix composite (CMC) vanes, and more particularly, to CMC vane insulators and methods of use.

Gaps or seams may enable hot gases from the gas flow path of a gas or steam turbine to leak into un-cooled or unprotected vane components. To facilitate reducing gas flow through such gaps, at least some known turbines pressurize these gaps with compressor air, also called purge air, to cause a positive outflow from the vane into the hot gas flow path. However, directing purge air at the interface between the vane and metallic support structure may cause undesirably high stresses to develop on the vane which over time, may reduce the life expectancy of the CMC vane.

At least some gas or steam turbines use ceramic materials having a higher temperature capability than the metallic type materials. One specific class of such non-metallic low thermal expansion materials is ceramic matrix composite (CMC) materials which can endure significantly higher temperatures than metals and also require reduced cooling requirements that can be translated into increased engine efficiency and output. However, because of the substantial difference in coefficients of thermal expansion between CMC materials and supporting metallic structures, substantial thermal stresses may develop in the CMC material which may adversely affect the life and functionality of vanes fabricated from CMC materials.

BRIEF DESCRIPTION OF THE INVENTION

In one aspect, a method for assembling a gas or steam turbine is provided. The method includes providing an insulator and positioning the insulator between a vane support and a vane such that the insulator facilitates preventing hot gas migration into the vane, and such that during operation, hot gas is channeled from a high pressure side of the vane to a low pressure side of the vane.

In another aspect, a vane assembly for a turbine rotor assembly is provided. The vane assembly includes a vane support and an insulator including a base portion and a projecting portion, the base portion includes a top surface and a bottom surface, the projecting portion extends from the base portion and includes at least one channel defined therein and positioned to substantially circumscribe an outer surface of the projecting portion. The assembly also includes a vane, and the insulator is coupled to the vane support such that the projecting portion is between the vane and a nozzle support strut to facilitate hot gas flow from a pressure side of the projecting portion to a suction side of the projecting portion.

In yet another aspect, an insulator for use with a vane assembly is provided. The insulator includes a base portion including a top surface and a bottom surface, a projecting portion extending from the top surface, the projecting portion includes an outer surface that substantially circumscribes the projecting portion and at least one channel defined in the outer surface. The insulator also includes at least one rib defined in the outer surface. The at least one rib is positioned between a pair of the at least one channel such that hot gas is facilitated to be channeled from a high pressure side of the vane assembly to a low pressure side of the vane assembly.

DETAILED DESCRIPTION OF THE INVENTION

Figure 1:
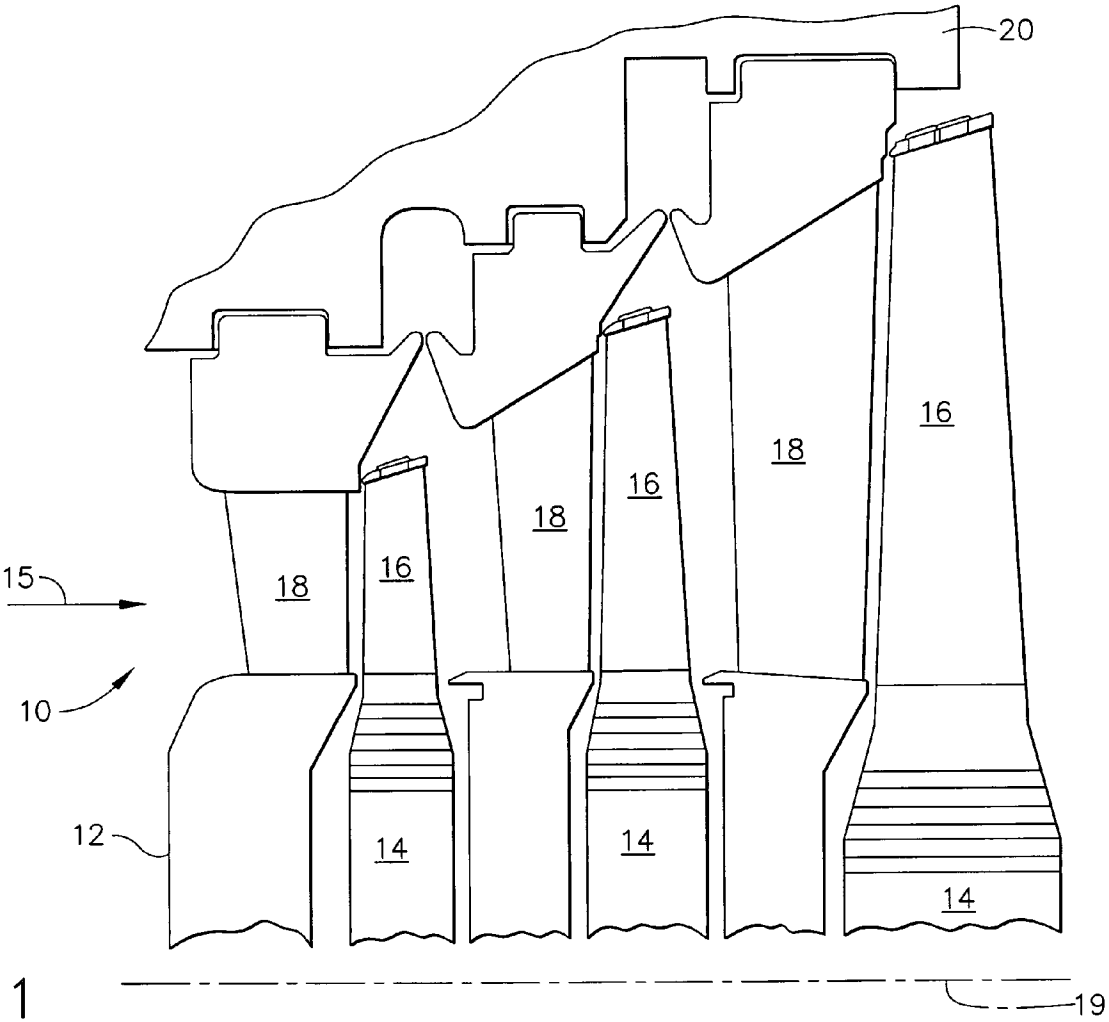
FIG. 1 is a cross-sectional schematic view of a portion of an exemplary gas or steam turbine.

FIG. 1 is a cross-sectional schematic view of a portion of an exemplary gas or steam turbine 10 including an impulse rotor assembly 12 and a plurality of axially spaced wheels 14 used to couple buckets 16 to rotor assembly 12. It should be appreciated that rotor assembly 12 may also be a drum rotor assembly. A series of nozzles 18 extend in rows between adjacent rows of buckets 16. Nozzles 18 cooperate with buckets 16 to form a stage and to define a portion of a gas or steam flow path, or a hot gas flow path, indicated by the arrow 15 that extends through turbine 10. It should be appreciated that the exemplary embodiments described herein may be implemented in the context of a steam turbine or a gas turbine. Accordingly, the hot gas described herein is steam for a steam turbine and a hot gas flow for a gas turbine.

In operation, depending on the type of turbine, high pressure hot gas or steam enters an inlet end (not shown) of turbine 10 and moves through turbine 10 parallel to the axis of rotor 12. The hot gas or steam strikes a row of nozzles 18 and is directed against buckets 16. The hot gas or steam then passes through the remaining stages, thus forcing buckets 16 and rotor 12 to rotate.

Figure 2:
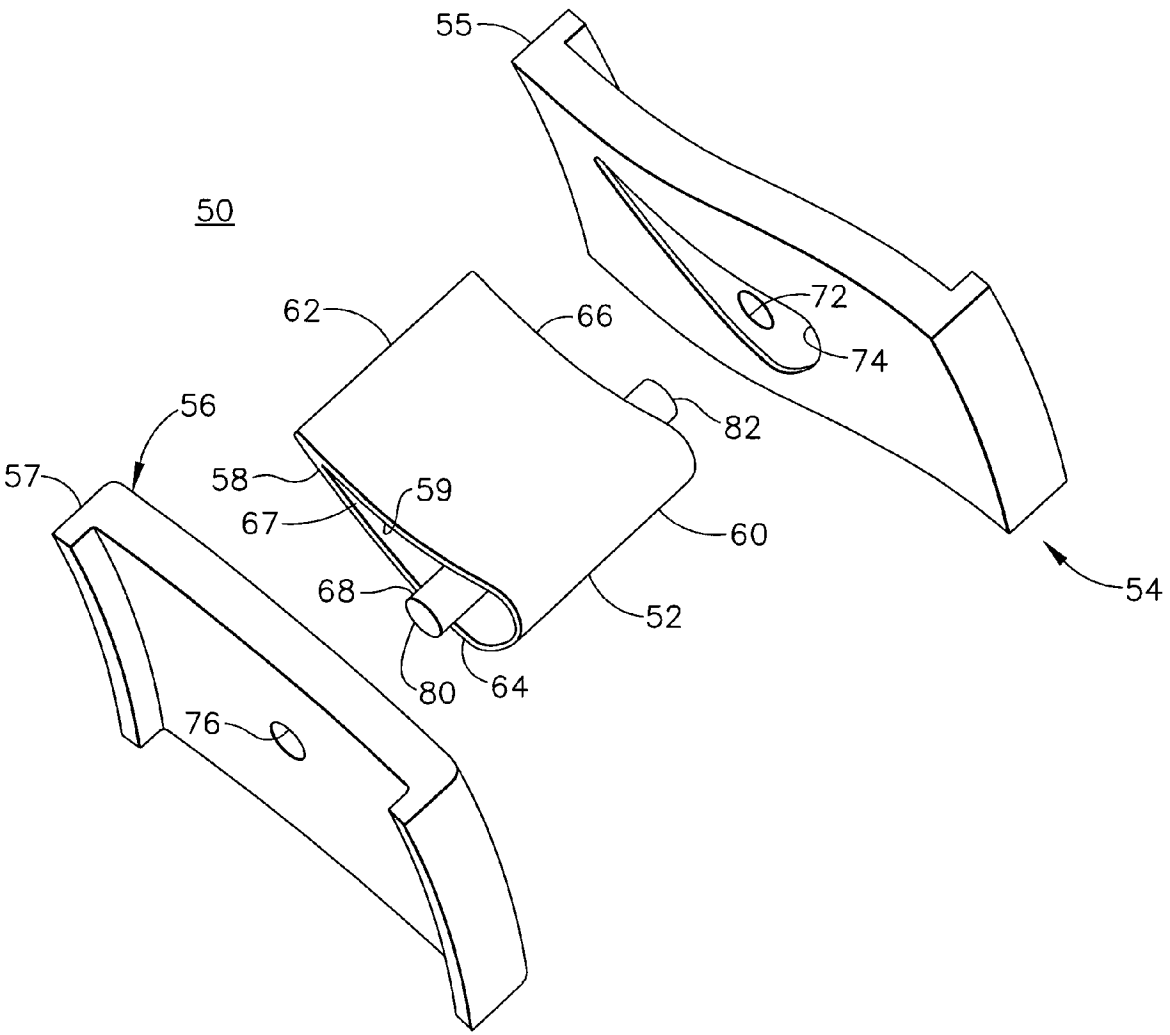
FIG. 2 is an exploded perspective view of an exemplary turbine nozzle assembly that may be used with the gas or steam turbine shown in FIG. 1.

FIG. 2 is an exploded perspective view of an exemplary turbine nozzle assembly 50 that may be used with the steam turbine 10 (shown in FIG. 1). Nozzle 50 includes a vane 52 fabricated from a ceramic matrix composite material (CMC) that extends between a radially outer band 54 having an outer surface 55 and a radially inner band 56 having an outer surface 57. Radially outer band 54 and/or radially inner band 56 may also be referred to as a vane support. Each vane 52 includes a suction sidewall 58 and a pressure sidewall 59. Suction sidewall 58 is convex and defines a suction side of vane 52, and pressure sidewall 59 is concave and defines a pressure side of vane 52. Sidewalls 58 and 59 are joined at a leading edge 60 and at an axially-spaced trailing edge 62 of vane 52.

Suction and pressure sidewalls 58 and 59, respectively, extend longitudinally, in span between radially inner band 56 and radially outer band 54. A vane root 64 is defined as being adjacent inner band 56, and a vane tip 66 is defined as being adjacent outer band 54. Additionally, suction and pressure sidewalls 58 and 59, respectively, define a cooling cavity 67 within vane 52.

Outer band 54 and inner band 56 each include an opening 72 and 76, respectively, extending therethrough. Moreover, outer band 54 includes an outer countersink portion 74 and an inner band 56 includes an inner countersink portion 78. Outer countersink portion 74 is sized and shaped to correspond to the outer periphery of vane tip 66 such that vane tip 66 fits within portion 74. Likewise, inner countersink portion 78 is sized and shaped to correspond to the outer periphery of vane root 64 such that vane root 64 fits within inner countersink portion 78. Turbine nozzle 50 includes a nozzle support strut 68 that extends through CMC vane 52. A radially inner end 80 of nozzle support strut 68 extends outward from vane root 64 and a radially outer end 82 of nozzle support strut 68 extends outward from vane tip 66.

Figure 3:
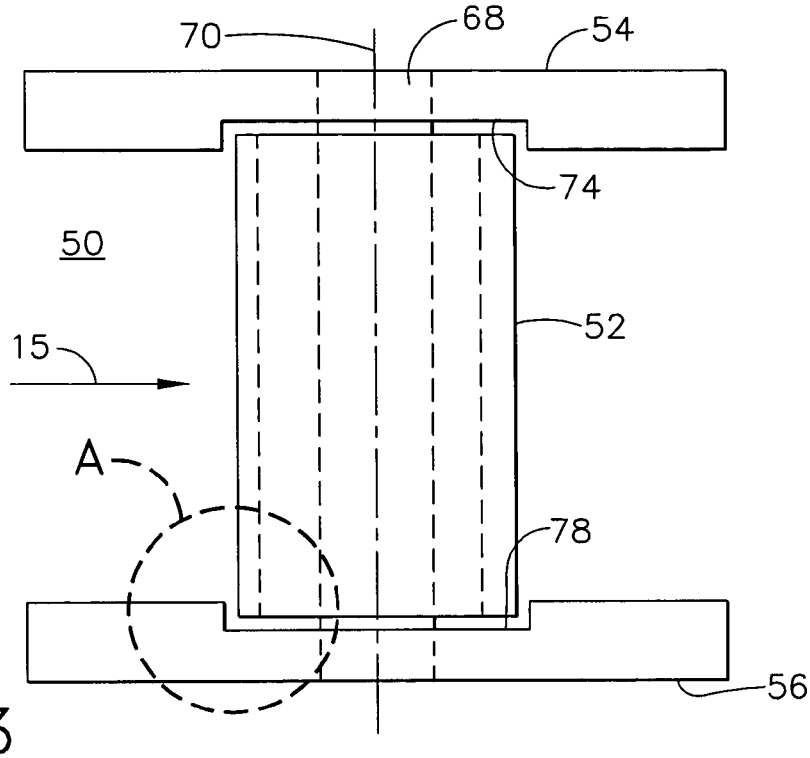
FIG. 3 is a front schematic view of the turbine nozzle assembly shown in FIG. 2 and fully assembled to include a vane fabricated from a ceramic matrix composite material.

FIG. 3 illustrates a front schematic view of turbine nozzle 50 in an assembled condition. CMC vane 52 is positioned between, and is coupled to, outer band 54 and inner band 56. Specifically, CMC vane 52 is coupled to outer band 54 by inserting outer end 82 into opening 72, and inserting CMC vane tip 66 into outer countersink portion 74. Similarly, CMC vane 52 is coupled to inner band 56 by inserting inner end 80 into opening 76 and inserting CMC vane root 64 into inner countersink portion 78.

Figure 4:
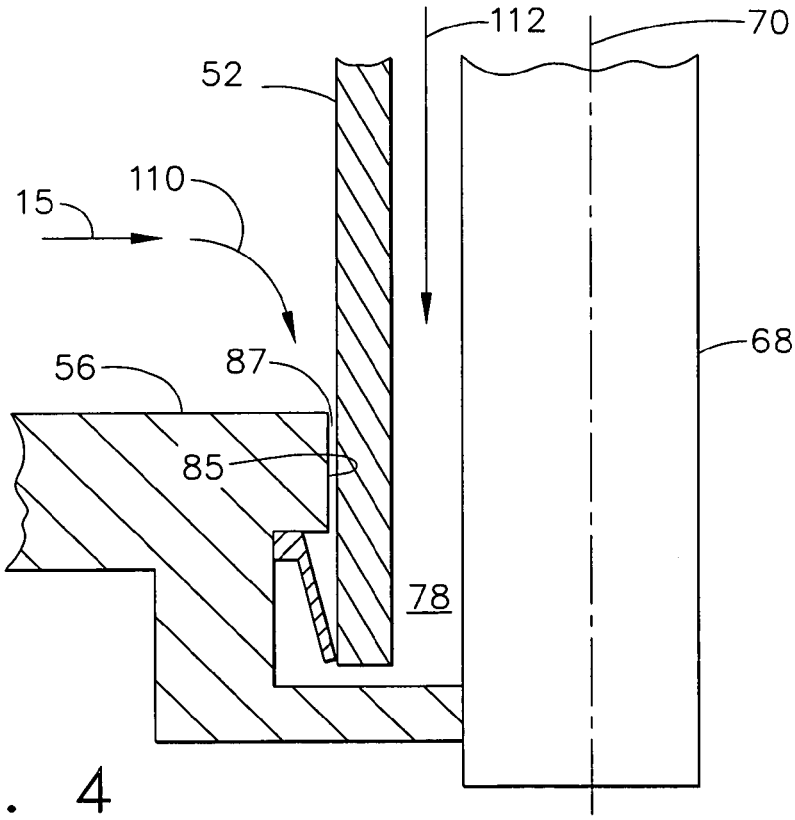
FIG. 4 is an enlarged schematic view of a portion of the CMC vane in FIG. 3 taken along area A.

FIG. 4 is an enlarged schematic view detailing an interface created between CMC vane 52 and inner band 56 taken along area A. Although only the interface between CMC vane 52 and inner band 56 has been illustrated and described, it should be understood that an interface between CMC vane 52 and outer band 54 is substantially identical. As such, the following description also applies to the interface between CMC vane 52 and outer band 54. Pressurized hot gas 110 flowing from the hot gas flow path 15 towards CMC vane 52 is illustrated with dashed lines while purge air 112 is illustrated with solid lines.

Figure 5:
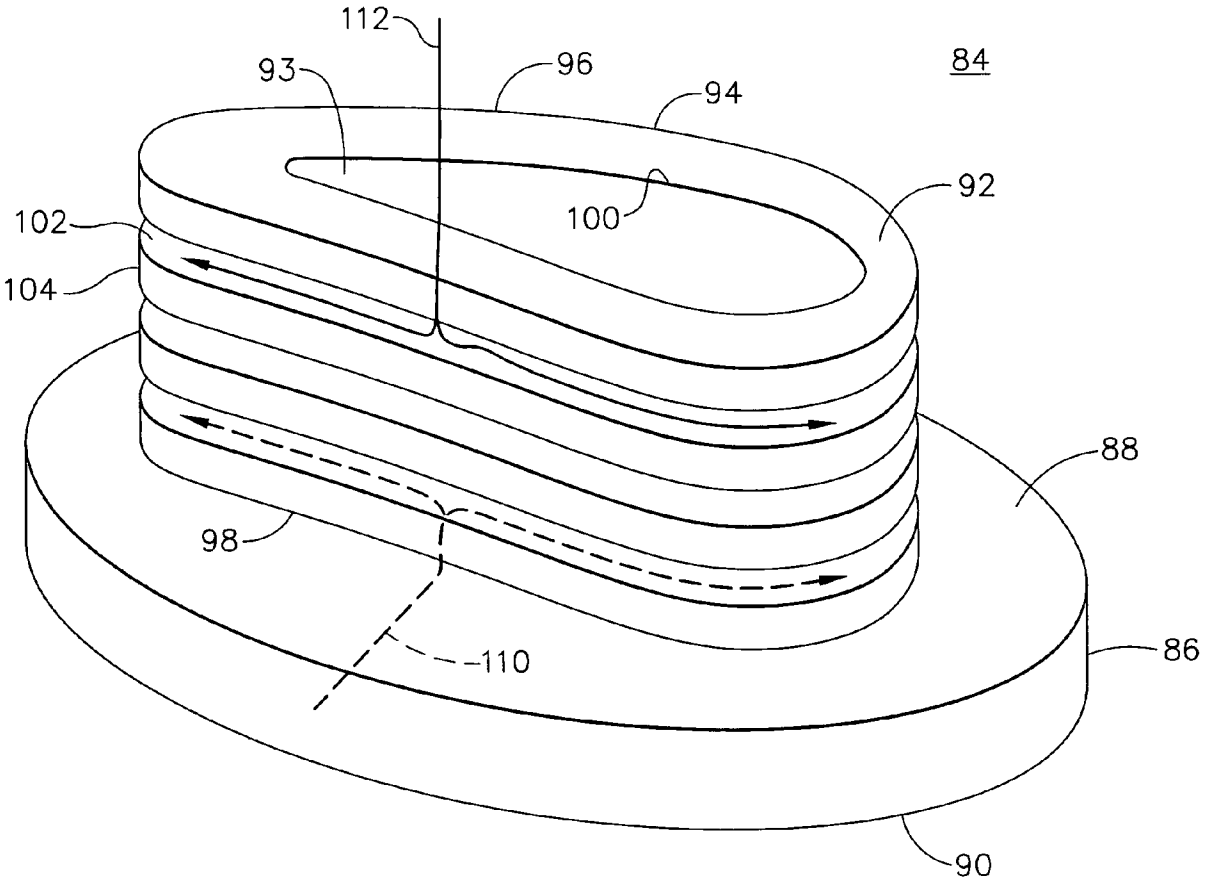
FIG. 5 is a perspective view illustrating an exemplary insulator that may be used with the turbine nozzle assembly shown in FIGS. 3 and 4.

FIG. 5 is a perspective view illustrating an exemplary insulator 84 that fits between the CMC vane 52 and inner band 56. Insulator 84 is similar to a labyrinth seal. Moreover, insulator 84 is fabricated from a material and includes a base 86, a member 92 and an opening 93 that extends through base 86 and member 92. In the exemplary embodiment, insulator 84 is fabricated from PM 2000 material which is a rigid, non-compliant oxide dispersion strengthened (ODS) alloy, that facilitates channeling hot gas 110 around CMC vane 52 and can endure the high temperatures of hot gas 110. PM2000 material is used in the exemplary embodiment because its temperature characteristics are such that less cooling purge air is required. It should be appreciated that although the exemplary embodiment uses PM2000 material, other embodiments may use any material, such as, but not limited to, CMC, that enables insulator 84 to function as described herein. Base 86 includes a top surface 88, a bottom surface 90 and is sized to fit between nozzle support strut 68 and vane support contact face 85. Member 92 includes an outer surface 94 that includes a suction side 96 and a pressure side 98. Pressure side 98 opposes pressure sidewall 59 and suction side 96 opposes suction sidewall 58. In addition, member 92 also includes an inner surface 100 that is defined by opening 93. In the exemplary embodiment, member 92 extends away from top surface 88, and inner surface 100 substantially circumscribes nozzle support strut 68 such that member 92 is insertable between CMC vane 52 and nozzle support strut 68.

In the exemplary embodiment, outer surface 94 includes a plurality of substantially parallel self-contained channels 102 and a plurality of substantially parallel ribs 104, such that each channel 102 is positioned between a pair of adjacent corresponding ribs 104 such that a square wave profile is defined. It should be appreciated that although the exemplary embodiment uses substantially parallel channels 102, other embodiments may use any orientation for channels 102, such as, but not limited to, channels 102 that are not parallel, that enables insulator 84 to function as described herein. In the exemplary embodiment, channels 102 and ribs 104 have substantially rectangular cross-sectional areas. Depending on the operating conditions, a single channel 102 may be adequate. However, during operating conditions with increased hot gas flow 110 that facilitates migration into CMC vane 52, additional channels 102 are used to accommodate the increased hot gas 110 flow. Channels 102 are designed to provide effective resistance to radial flow of hot gas 110, by providing a flow path of least resistance about the vane 52.

Figure 6:
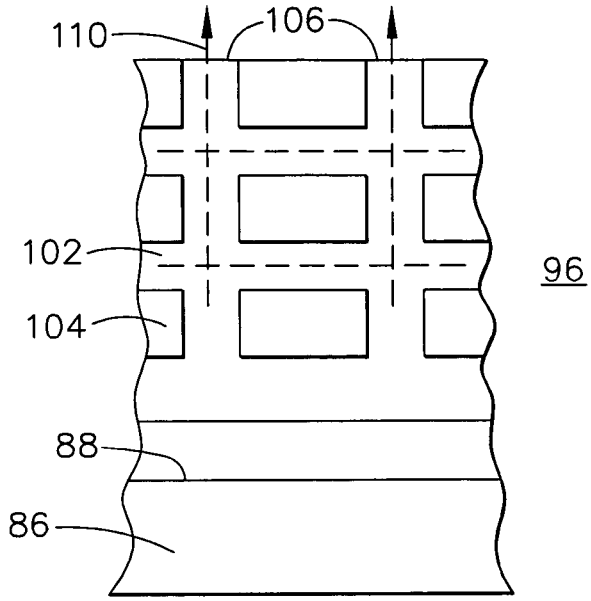
FIG. 6 is a partial suction side view of the insulator shown in FIG. 5.

FIG. 6 is a rear view of insulator 84 and illustrates a portion of suction side 96. In the exemplary embodiment, suction side 96 includes a plurality of venting channels 106 that extend from base 86 to top surface 88 and are in flow communication with channels 102. In the exemplary embodiment, venting channels 106 have a substantially rectangular cross-sectional area and intersect with channels 102 at generally right angles. However, it should be appreciated that venting channels 106 may have any cross-sectional area and/or may intersect with channels 102 at any angle that enables venting channels 106 to function as described herein.

It should be appreciated that although base 86 has an elliptical shape in the exemplary embodiment, in other embodiments, base 86 may be non-elliptically shaped. It should be further appreciated that member 92 may extend at any angle away from base 86, and that channels 102 and ribs 104 may have any cross-sectional area that enables channels 102 and venting channels 106 to function as described herein. Moreover, it should be appreciated that ribs 104 define a reduced contact area with CMC vane 52 and thereby facilitate reducing heat transfer between CMC vane 52 and inner band 56.

Figure 7:
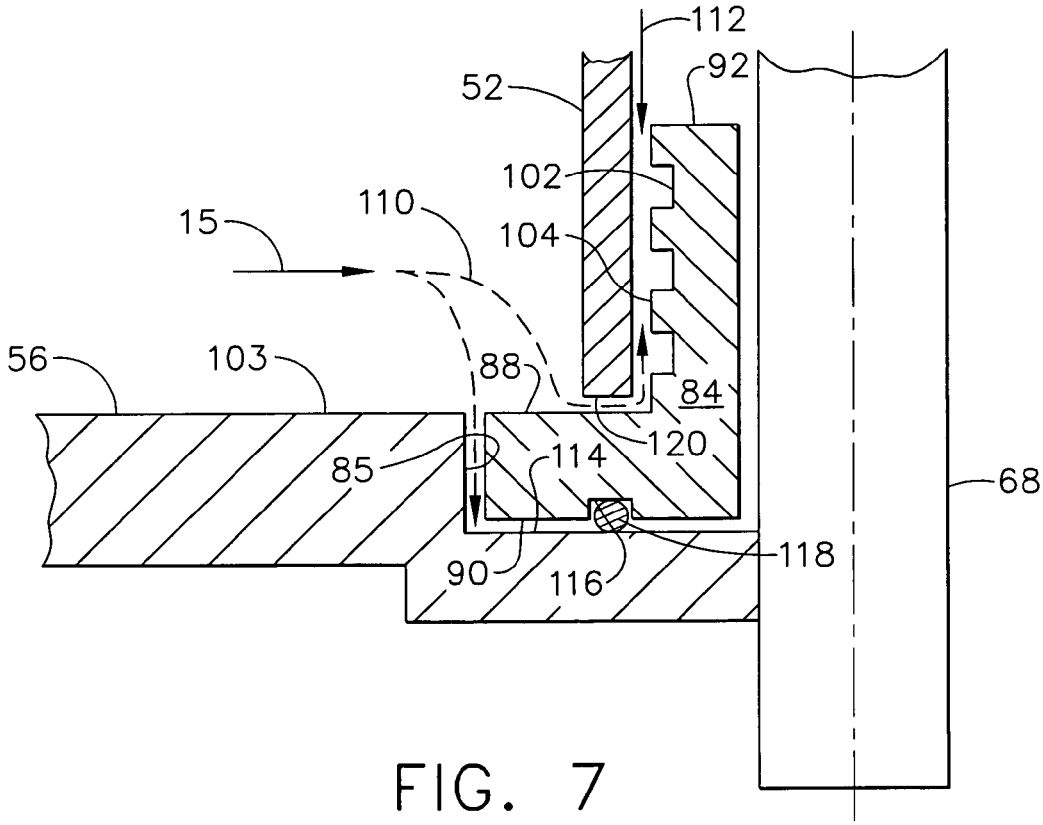
FIG. 7 is an enlarged schematic view of an exemplary interface between the CMC vane and metallic support structure shown in FIG. 3, region A, and including the insulator shown in FIG. 5.

FIG. 7 is an enlarged schematic view of the interface detail between CMC vane 52 and inner band 56, including insulator 84. In the exemplary embodiment, insulator 84 is disposed between inner band 56 and CMC vane 52. More specifically, in the exemplary embodiment, base 86 is positioned in inner countersink portion 78 such that top surface 88 is substantially flush with inner band surface 103. Bottom surface 90 is positioned against inner band bottom surface 114 and, in the exemplary embodiment, includes a substantially rectangularly shaped channel 116. A gasket 118 positioned within channel 116 contacts inner band bottom surface 114 such that bottom surface 90 is sealed against inner band bottom surface 114. Gasket 118 facilitates preventing hot gas 110 from migrating into CMC vane 52. However, hot gas 110 may also migrate into pressure side 98 via the interface defined between a bottom surface 120 of CMC vane 52 and top surface 88. Hot gas 110 along this interface may migrate between CMC vane 52 and pressure side 98 into pressure side channels 102. Because hot gas 110 is under high pressure, it naturally flows from pressure side 98 through channels 102 towards suction side 96. Moreover, hot gas 110 may flow around CMC vane 52 in two directions through channels 102 to suction side 96, unlike in a labyrinth seal. Hot gas 110 escapes from channels 102 on suction side 96 through venting channels 106 and enters the hot gas flow path 15.

By channeling hot gas 110 from the high pressure side 98 to the suction side 96 of CMC vane 52, and using PM2000 material for insulator 84, the exemplary embodiment facilitates controlling hot gas 110 leakage into vane 52 using minimal to no purge air. Moreover, the exemplary embodiment facilitates reducing thermal gradients in the CMC vane 52 and facilitates protecting inner band 56 from the direct impingement of hot gas 110.

Figure 8:
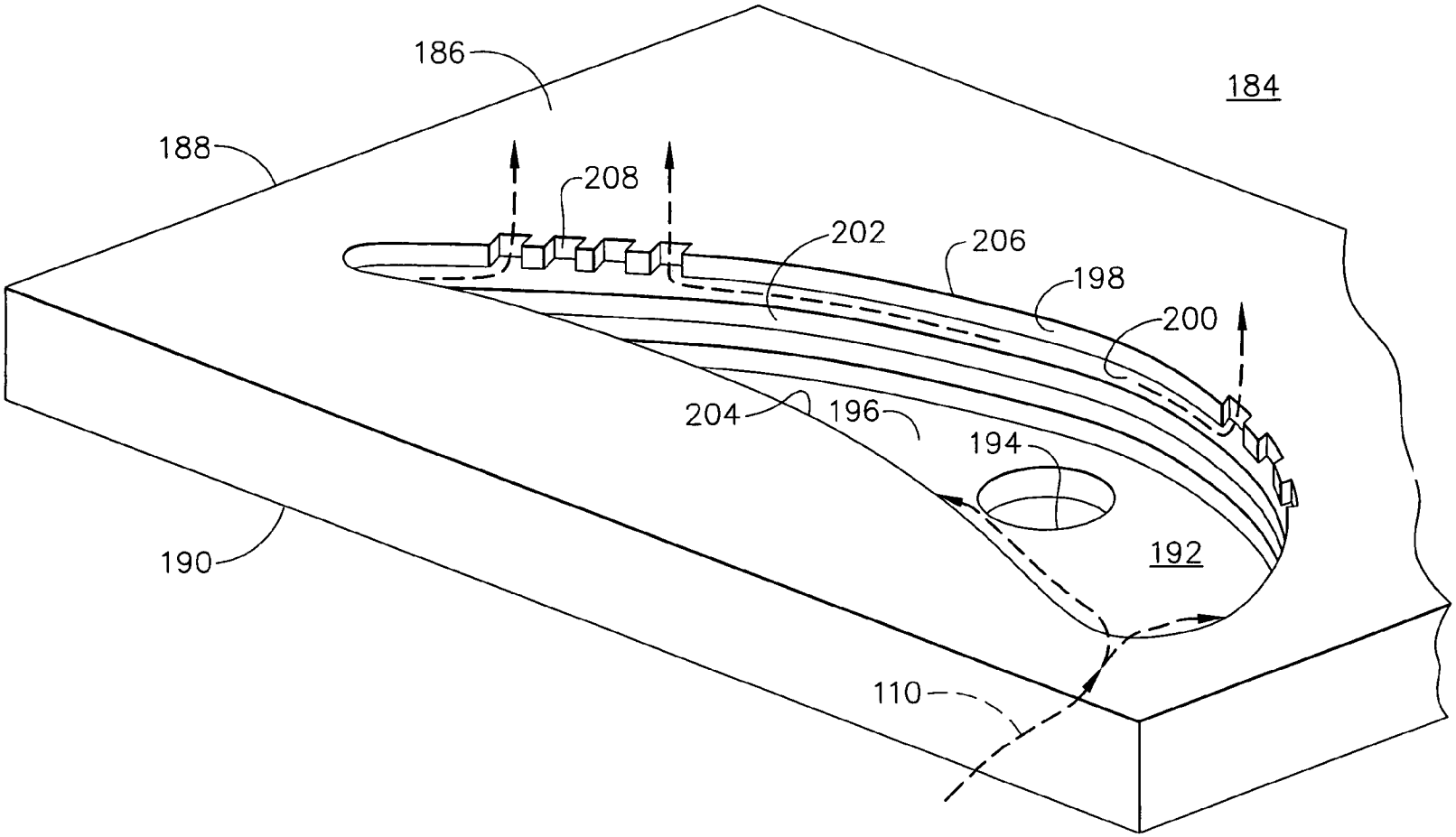
FIG. 8 is a perspective view of an alternative embodiment of an insulator that may be positioned between the CMC vane and metallic support structure shown in FIG. 4.

FIG. 8 is a perspective view of an alternate embodiment of an insulator 184 sized to be positioned between CMC vane 52 and inner band 56. In the exemplary embodiment, insulator 184 is similar to a labyrinth seal. Moreover, in the exemplary embodiment, insulator 184 is fabricated from PM2000 material and includes a base 186 having a top surface 188 and a bottom surface 190. In the exemplary embodiment, insulator 184 is fabricated from PM 2000 material which is a rigid, non-compliant oxide dispersion strengthened (ODS) alloy, that facilitates channeling hot gas 110 around CMC vane 52 and can endure the high temperatures of hot gas 110. PM2000 material is used in the exemplary embodiment because its temperature characteristics are such that less cooling purge air is required. It should be appreciated that although the alternate embodiment uses PM2000 material, other embodiments may use any material, such as, but not limited to, CMC, that enables insulator 184 to function as described herein. Top surface 188 includes an insulator countersink 192 that substantially circumscribes either CMC vane tip 66 or CMC vane root 64. Insulator countersink 192 includes an opening 194 that extends from a bottom surface 196 of insulator countersink 192 to bottom surface 190. Opening 194 is sized to accommodate and circumscribe nozzle support strut 68.

Insulator countersink 192 also defines a sidewall 198 including a plurality of substantially parallel self-contained channels 200 and a plurality of substantially parallel ribs 202. It should be appreciated that although the exemplary embodiment uses substantially parallel channels 200, other embodiments may use any orientation for channels 200, such as, but not limited to, channels that are not parallel, that enable insulator 184 to function as described herein. Each channel 200 is positioned between a pair of adjacent corresponding ribs 202, such that a square wave profile is defined. Channels 200 and ribs 202 have substantially rectangular cross-sections. Sidewall 198 includes a pressure side 204 opposing pressure sidewall 59 and a suction side 206 opposing suction sidewall 58. Suction side 206 includes a plurality of substantially rectangularly shaped venting channels 208 extending from top surface 188 towards countersink bottom surface 196. Venting channels 208 are in flow communication with channels 200. In the exemplary embodiment, venting channels 208 have a substantially rectangular cross-sectional area and intersect with channels 200 at generally right angles. However, it should be appreciated that venting channels 208 may have any cross-sectional area and/or may intersect with channels 200 at any angle that enables venting channels 200 to function as described herein.

It should be further appreciated that channels 200 and ribs 202 may have any cross-sectional area that enable channels 200 and venting channels 208 to function as described herein. Moreover, it should be appreciated that ribs 202 define a reduced contact area with CMC vane 52 and thereby facilitate reducing heat transfer between CMC vane 52 and inner band 56.

Figure 9:
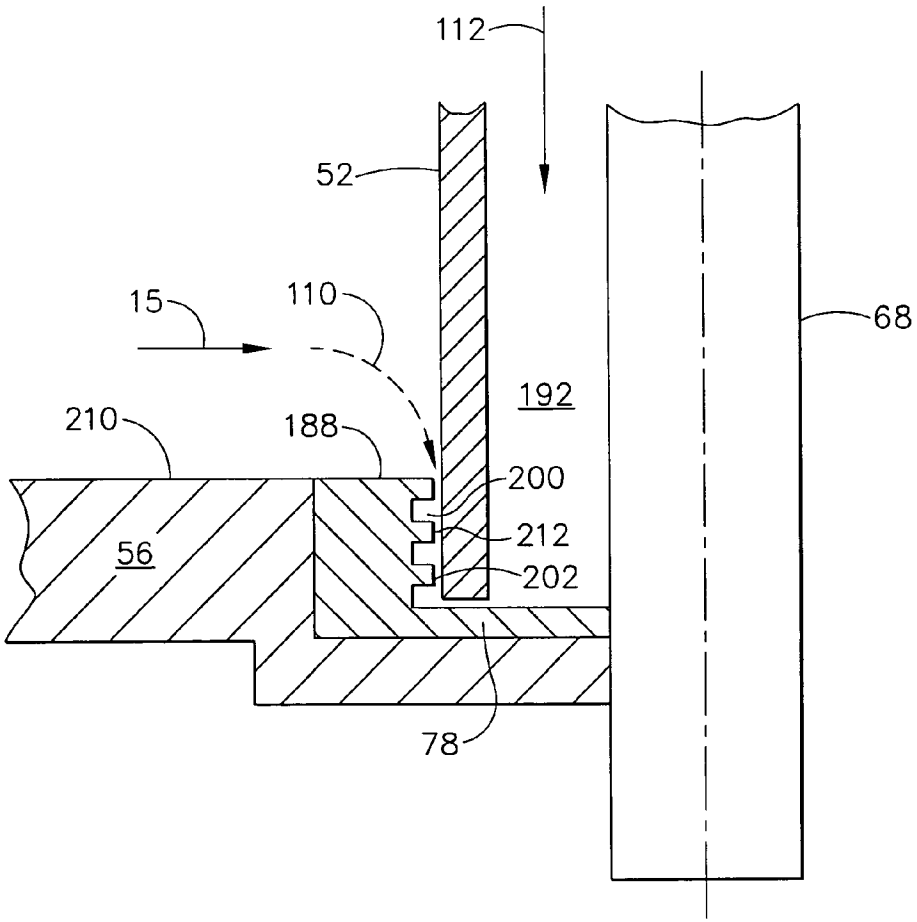
FIG. 9 is an enlarged schematic view of another exemplary interface between the CMC vane and metallic support structure shown in FIG. 3, region A, and including the insulator shown in FIG. 8.

FIG. 9 is an enlarged partial cross-sectional schematic view of the interface defined between CMC vane 52 and inner band 56, including insulator 184. In the exemplary embodiment, insulator 184 is positioned within inner countersink portion 78 and CMC vane 52 is positioned within insulator 184. More specifically, in the exemplary embodiment, base 186 is positioned in inner countersink portion 78 such that top surface 188 is substantially flush with inner band surface 210. A lower portion of CMC vane 52 extends into insulator countersink 192, and an upper portion of CMC vane 52 extends into hot gas flow path 15. Moreover, CMC vane 52 is disposed within insulator countersink 192 such that an interface 212 is defined between CMC vane 52 and ribs 202. Hot gas 110 along this interface may migrate between CMC vane 52 and ribs 202 into pressure side channels 200. Because hot gas 110 is under high pressure, it naturally flows from pressure side 204 through channels 200 to suction side 206. Moreover, hot gas 110 may flow in two directions from pressure side 204 through channels 200 to suction side 206, unlike in a labyrinth seal. Hot gas 110 escapes from channels 200 on suction side 206 through venting channels 208 and enters into hot gas flow path 15.

By channeling hot gas 110 from the high pressure side 204 to the suction side 206 of CMC vane 52, and using PM2000 material for insulator 184, the exemplary embodiment facilitates controlling hot gas 110 leakage into vane 52 using minimal to no purge air. Moreover, the exemplary embodiment facilitates reducing thermal gradients in the CMC vane 52 and facilitates protecting inner band 56 from the direct impingement of hot gas 110.

In each embodiment the above-described insulators facilitate thermal balance across CMC vane 52, facilitate minimizing thermal gradients and facilitate improving CMC vane 52 durability. More specifically, in each embodiment, the insulator facilitates controlling hot gas migration by channeling high pressure hot gas 110 from the high pressure side of CMC vane 52 towards the low pressure side of CMC vane 52. As a result, turbine operation facilitates using less purge air and reduces CMC vane stresses. Accordingly, gas or steam turbine performance and component useful life are each facilitated to be enhanced in a cost effective and reliable means. It should be appreciated that the embodiments described herein may also be used with stationary vanes.

Exemplary embodiments of insulators are described above in detail. The insulators are not limited to use with the specific gas or steam turbine embodiments described herein, but rather, the insulators can be utilized independently and separately from other insulator components described herein. Moreover, the invention is not limited to the embodiments of the insulators described above in detail. Rather, other variations of insulator embodiments may be utilized within the spirit and scope of the claims.

While the invention has been described in terms of various specific embodiments, those skilled in the art will recognize that the invention can be practiced with modification within the spirit and scope of the claims.

What is claimed is:

1. A method for assembling a turbine, said method comprising:

providing an insulator that includes a base portion having a top surface and a bottom surface;

forming a channel in the bottom surface; and positioning the insulator between a vane support and a vane such that the insulator facilitates preventing hot gas migration into the vane, and such that during operation, hot gas is channeled from a high pressure side of the vane to a low pressure side of the vane.

2. A method in accordance with claim 1 further comprising providing an insulator that further includes a projecting portion that extends away from the top surface and includes an outer surface that substantially circumscribes the projecting portion and that includes a pressure surface and a suction surface.

3. A method in accordance with claim 2 further comprising forming at least one channel in the outer surface of the projecting portion.

4. A method in accordance with a claim 3 further comprising forming at least one venting channel in the suction surface, wherein the at least one venting channel communicates with the at least one channel to enable hot gas to escape to a hot gas flow path during turbine operation.

5. A method in accordance with claim 2 further comprising positioning a seal member in the bottom channel to facilitate sealing the bottom surface to the vane support.

6. A method in accordance with claim 2 further comprising positioning the insulator to substantially circumscribe the vane; and positioning the projecting portion between the vane and a nozzle support strut.

7. A method in accordance with claim 2 further comprising positioning the insulator to substantially circumscribe the vane; and positioning the projecting portion between the vane support and the vane.

8. A method in accordance with claim 2 further comprising positioning the top surface of the base portion flush with an inner surface of the vane support.

9. A vane assembly for a turbine rotor assembly, said vane assembly comprising:

a vane support;

an insulator comprising a base portion and a projecting portion, said base portion comprising a top surface and a bottom surface, said projecting portion extending from said base portion and comprising at least one channel defined therein and positioned to substantially circumscribe an outer surface of said projecting portion, said bottom surface comprising a channel defined therein; and a vane, said insulator is coupled to said vane support such that said projecting portion is between said vane and a nozzle support strut to facilitate hot gas flow from a pressure side of said projecting portion to a suction side of said projecting portion.

10. A vane assembly in accordance with claim 9 further comprising at least one venting channel defined in said projecting portion suction side, said at least one venting channel is in flow communication with said insulator at least one channel to facilitate channeling hot gas to a hot gas flow path.

11. A vane assembly in accordance with claim 10 further comprising a seal member positioned in said bottom channel to facilitate sealing said bottom surface to said vane support.

12. A vane assembly in accordance with claim 9 wherein said insulator substantially circumscribes said vane, said projecting portion is positioned between said vane and said nozzle support strut.

13. A vane assembly in accordance with claim 9 wherein said insulator substantially circumscribes said vane, said projecting portion is positioned between said vane support and said vane.

14. A vane assembly in accordance with claim 9 wherein an upper portion of said vane is positioned in a hot gas flow path and a lower portion of said vane is positioned in said vane support.

15. A vane assembly in accordance with claim 9 wherein said top surface is substantially flush with a surface of said vane support.

16. An insulator for use with a vane assembly, said insulator comprises:

a base portion comprising a top surface and a bottom surface, said bottom surface comprising a channel defined therein;

a projecting portion extending from said top surface, said projecting portion comprising an outer surface that substantially circumscribes said projecting portion and at least one channel defined in said outer surface; and at least one rib defined in said outer surface, said at least one rib positioned between a pair of said at least one channel such that hot gas is facilitated to be channeled from a high pressure side of said vane assembly to a low pressure side of said vane assembly.

17. An insulator in accordance with claim 16 wherein said pair of said at least one channel and said at least one rib define a square wave profile.

18. An insulator in accordance with claim 16 further comprising an opening extending through said base portion and said projecting portion, said opening configured for accommodating a nozzle support strut.

19. An insulator in accordance with claim 16 wherein said bottom surface further comprises a seal member positioned in said bottom channel to facilitate sealing said bottom surface to a vane support.

* * * * *

UNITED STATES PATENT AND TRADEMARK OFFICE

CERTIFICATE OF CORRECTION

PATENT NO. : 7,625,170 B2
APPLICATION NO. : 11/526501
DATED : December 1, 2009
INVENTOR(S) : Greene et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 353 days.

Signed and Sealed this

Twenty-first Day of December, 2010

David J. Kappos

David J. Kappos
*Director of the United States Patent and Trademark Office*